US005387884A

United States Patent [19]

Porcello

[11] Patent Number: 5,387,884

[45] Date of Patent: Feb. 7, 1995

[54] IMPEDANCE MATCHING FLANGE FOR A RECTANGULAR WAVEGUIDE

[75] Inventor: John C. Porcello, Williamsport, Pa.

[73] Assignee: Litton Systems, Inc., Beverly Hills, Calif.

[21] Appl. No.: 91,178

[22] Filed: Jul. 13, 1993

[51] Int. Cl.[6] ..... H01P 5/04

[52] U.S. Cl. ..... 333/33; 333/253; 333/254

[58] Field of Search ..... 333/33, 252–254

[56] References Cited

U.S. PATENT DOCUMENTS

| | | | |
|---|---|---|---|
| 2,588,262 | 3/1952 | Mataré | 333/252 X |
| 2,770,784 | 11/1956 | Hatch | 333/253 X |
| 3,577,106 | 5/1971 | Varhelyi | 333/253 |

OTHER PUBLICATIONS

Southworth Principles & Applications of Waveguide Transmission, Van Nostrand Co., New York, N.Y., 1950, p. 247.

*Primary Examiner*—Paul Gensler

*Attorney, Agent, or Firm*—Elliott N. Kramsky

[57] ABSTRACT

A method and apparatus for adjusting the impedance of an electromagnetic energy-actuated device. An auxiliary test flange includes a substantially planar metallic member. An internal aperture matches the dimensions of the waveguide cavity formed at the mating ports of adjacent electromagnetic energy-actuated devices. The member includes an access groove for a metallic stub, permitting the stub to be inserted from an edge of the member into the aperture. Measurements of energy transfer are made as the stub is inserted to thereby adjust either the capacitive or inductive impedance to energy transfer. After a predetermined degree of energy transfer is observed, one or the other of the devices may be modified by the addition of a permanent auxiliary flange or directly modified in accordance with the optimized aperture reduction.

7 Claims, 2 Drawing Sheets

FIG. 1
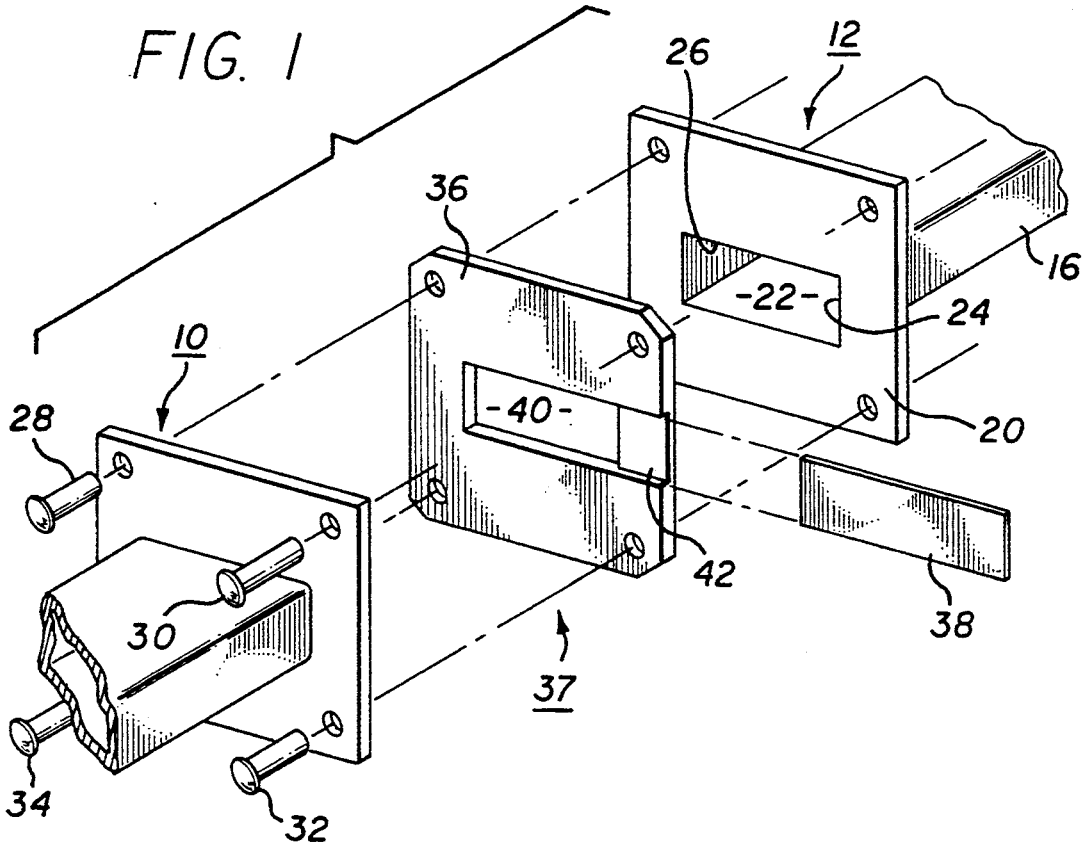
FIG. 3
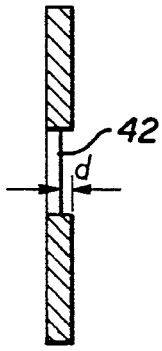
FIG. 2(b)
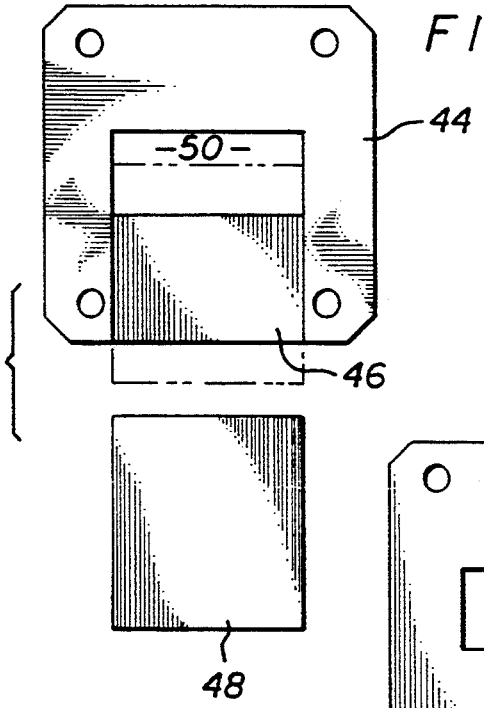
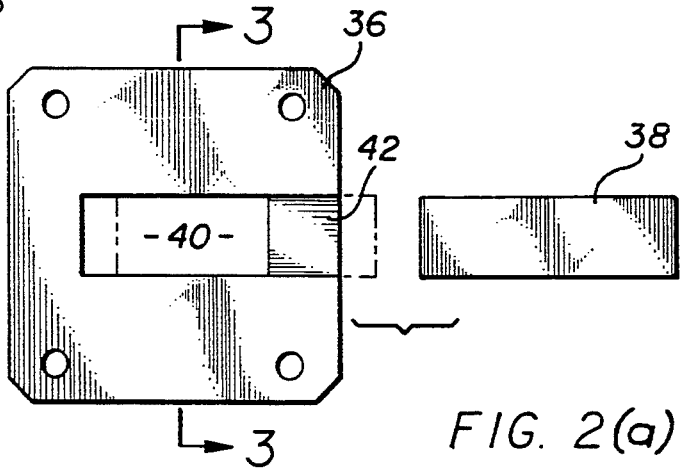
FIG. 2(a)

IMPEDANCE MATCHING FLANGE FOR A RECTANGULAR WAVEGUIDE

BACKGROUND

1. Field of the Invention

The present invention relates to apparatus and methods for impedance matching in microwave and millimeter wave circuits. More particularly, this invention pertains to an auxiliary flange for adjusting the impedance of a device of the type that includes a port of the rectangular waveguide type, within a microwave or millimeter wave circuit.

2. Description of the Prior Art

The coupling of microwave and millimeter wave energy within microwave and millimeter wave circuits is highly dependent upon the design of the physical circuit elements and transmission lines. Quite often, electromagnetic incompatibilities in the physical dimensions of interconnected devices create undesired reflections of energy that limit power transmission. On the other hand, it is often desirable and beneficial to design some reflectivity elements into microwave and millimeter wave circuitry to reduce power transmission to less-than-maximum levels. For example, some microwave tube applications cannot run at maximum power without harm to the surrounding environment.

The important regulation of power transfer within millimeter and microwave circuitry is often implicit in the design of circuit elements. Designs commonly incorporate "stubs" and the like for affecting input and output impedances. By the deliberate creation of impedance mismatches between devices, a predetermined degree of power transfer may be obtained. Conversely, through careful matching of device impedances, it is possible to obtain near-total power transfer.

The design of microwave and millimeter wave circuits that possess desired impedance characteristics is well-understood by those skilled in the art and is discussed, for example, in N. Marcuvitz, "Waveguide Handbook", *Radiation Laboratory Series*, v. 10 (MacGraw-Hill 1951). As mentioned above, a recognized element for adjusting the impedance of a microwave circuit is the stub which, when inserted into the path of propagation of energy, will introduce a disturbance that mimics a change in either the capacitance or the inductance of the associated circuit. The character of the effect will depend upon the physical relationship of the disturbance to the rest of the circuit at the frequency of interest.

While careful circuit design can employ stubs for creating desired impedance values, for a number of reasons it is often quite difficult to adjust impedance levels after the fact. For example, optimum design will vary with changes in operating frequency. This may require one to discard an otherwise useful device designed for operation at one frequency rather than put it to use in a different application. Manufacturing tolerances (or design errors) frequently result in the production of devices that fall outside optimum performance levels.

The ability to correct impedance levels and to thereby avoid discarding potentially-useful devices is highly prized. The correction of impedance mismatches is, unfortunately, not a simple task at present. The post-manufacture correction of impedance levels is very difficult in some cases. Such difficulty is quite often related to the peculiarities of structure and operation of particular types of microwave and millimeter wave devices. These factors may prohibit the use of physically-intrusive methods of adjustment. For example, the interior of a microwave tube must be evacuated and support a vacuum. Ceramic "pill box" windows seal the ports of the tube, each comprising a section of loaded rectangular waveguide. To adjust the tube's impedance after manufacture, one must break the vacuum to obtain interior access, a costly and time-consuming step that severely limits the ability to perform trial-and-error adjustment methods. Accordingly, the designer is limited to analytical solutions, restricting his ability to "fine tune" devices to compensate for factors that cannot be adequately modeled mathematically, thereby forcing reliance upon such recognized sources such as the "Waveguide Handbook" ibid, and well-known Smith Chart procedures. In addition to depriving the designer of an option, analytical methods require relatively high-skilled labor that renders the process of adjusting impedance quite costly.

SUMMARY OF THE INVENTION

The foregoing and other shortcomings of the prior art are addressed by the present invention that provides, in a first aspect, apparatus for adjusting the impedance of a device of the type that includes a port comprising a rectangular waveguide. Such apparatus includes a substantially-planar metallic member. Means are provided for fixing the member to the port. The member has an internal aperture and means are provided for adjusting the size of the aperture.

In a second aspect, the invention provides a method for adjusting the impedance of a first device of the type that includes a port comprising a first rectangular waveguide relative to that of a second device of the type that includes a port comprising a second rectangular waveguide. Such method includes the step of inserting a substantially planar metallic member between and in mutual contact with the waveguides. Such member includes an internal aperture and a groove connecting the aperture to an edge thereof.

Electromagnetic energy is then directed from the first device to the second device through the ports and the energy coupled from the first to the second device is then measured. Thereafter a substantially-planar metallic stub is slid within the groove to thereby reduce the size of the aperture and the electromagnetic energy transmitted into the second device is measured. Thereafter, the above steps are repeated until a predetermined amount of electromagnetic energy is transmitted into the second device.

The preceding and other features of the invention will become further apparent from the detailed description that follows. Such description is accompanied by a set of drawing figures. Numerals of the drawing figures, corresponding to those of the written description, point to the features of the invention. Like numerals refer to like features throughout both the drawing figures and the written description.

BRIEF DESCRIPTION OF THE DRAWINGS

FIG. 1 is an exploded perspective view of the invention;

FIGS. 2(*a*) and 2(*b*) are frontal planar views of impedance adjustment members, with disturbance-inducing positions in shadow outline, in accordance with the invention for introducing inductive and capacitive disturbances respectively;

FIG. 3 is a side sectional view of the adjustable aperture in accordance with the invention.

DETAILED DESCRIPTION

Figure 4A:
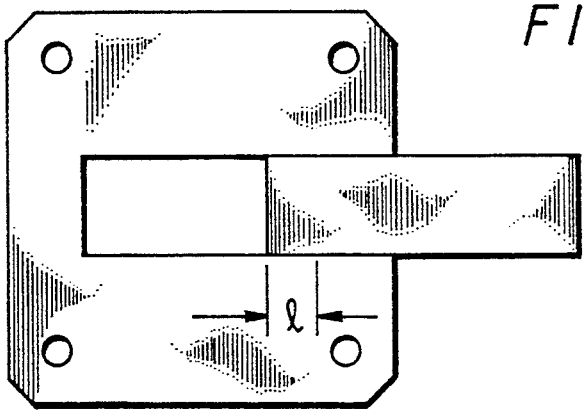
FIGS. 4(*a*) through 4(*c*) are frontal views of the auxiliary test flange of the invention with reduced aperture, a corresponding permanent auxiliary flange and a modified device port respectively, each incorporating the same electromagnetic disturbance in accordance with the invention.

FIG. 1 is an exploded perspective view of the invention. The invention addresses the aforementioned problems associated with matching (or creating a predetermined mismatch between) the impedances of electromagnetic energy-actuated devices 10, 12. Each of such electromagnetic devices includes a port that comprises, in part, a length of rectangular waveguide 14, 16.

As shown in FIG. 1, the mating ports of the devices 10 and 12 terminate in generally-planar flanges 18 and 20 respectively. Each of such flanges includes a rectangular internal aperture, such as the aperture 22 of the flange 20, preferably having dimensions identical to that of the interior of the associated waveguide. Accordingly, the height 24 and the width 26 of the illustrated aperture 22 preferably mirror the corresponding internal dimensions of the waveguide 16. (Likewise, the same considerations apply to the corresponding port of the electromagnetic energy-actuated device 10.)

The devices 10 and 12 may comprise any of a number of well-recognized devices designed for energization by means of microwave or millimeter wave energy. Microwave energy generally falls within a frequency range of about 3 to 30 GHz while millimeter wave energy generally exceeds 30 GHz in frequency. One or more of the devices 10, 12 may comprise, for example, a transmission line of standard operational dimensions while the other device may comprise a microwave tube for a radar or the like. It is only necessary, for purposes of the present invention, that the devices 10 and 12 include conventional ports of the type described for linkage in a test or operational circuit arrangement.

The particular dimensions of the waveguide and the aperture forming a port of a device is crucial and closely related to its operational frequency. As is well known, waveguide dimensions, in combination with frequency, determines the mode or modes that can be supported (i.e. transmitted) therethrough. Generally, rectangular waveguide is designed to support $TE_{10}$ mode energy within the desired bandwidth.

Some electromagnetic energy-actuated devices, such as microwave tubes, which require an internal vacuum, employ a dielectric-loaded port design in which the rectangular metallic waveguide portion of the port is filled with a ceramic material for sealing purposes. Due to the invisibility of the ceramic to electromagnetic energy, the sealed waveguide of the port does not disturb the transmission of electromagnetic energy therein. In the meantime, by maintaining an airtight enclosure, the tube can be evacuated to create the necessary vacuum. The invention allows impedance matching of the microwave tube without disturbing the vacuum envelope.

Conventional fastening means 28, 30, 32 and 34, in combination with matching holes at the corners at the flanges 18 and 20, are routinely provided for securing the ports to one another during operation.

In accordance with the invention, an auxiliary flange 37 is provided for "fine tuning" the impedance of the coupling between the devices 10 and 12. The auxiliary flange 37 includes a metallic plate 36 that functions in conjunction with an insertable generally-planar metallic stub 38.

The flange 37 serves as an adjustable impedance element for use in modifying one of the devices 10 or 12 to create a desired power transfer relationship between them. It accomplishes this by providing means for incrementally inserting the metallic stub 38 into the path of transmission of electromagnetic energy between the devices 10 and 12. By monitoring the amount of energy transferred to the receiving device 10 or 12, it is then possible to infer the inductive or capacitive adjustment to the impedance of one of the devices to match (or intentionally mismatch) the impedances therebetween so that a desired degree of power transfer is obtained. Thereafter, a "permanent" member may be fabricated that possesses the same inductive or capacitive (or both) characteristics with regard to the disturbance of transmission of electromagnetic energy and such permanent device may then be permanently affixed to one of the devices 10 of 12. Often, one of the devices 10, 12 will be a "standard" device such as a transmission line of conventional length, for coupling to the other device. As such, it may be employed as a surrogate or test device for calibration of the other device, such as a microwave tube, for use "in the field".

An aperture 40 is provided at the interior of the metallic plate 36. A groove 42 in a surface of the plate 36 connects the interior of the aperture 40 to the edge of the plate 36. The width of the groove 42 is equal to the height of the aperture 40 and coincides with the height of the metallic stub 38. It will be seen below that the auxiliary flange 37 of FIG. 1 is configured to introduce an inductive disturbance. In contrast, an alternative embodiment is capable of introducing a capacitive disturbance. In the event that both inductive and capacitive disturbances are desired, this result can be obtained by inserting inductive and capacitive auxiliary flanges in a sandwich-like arrangement between the ports of the devices 10 and 12.

The aperture 40 within the plate 36 is preferably of substantially identical dimensions, and is aligned with, the aperture 22 (and a corresponding aperture of the device 10) and the interiors of the waveguide elements 14 and 16. Thus, prior to insertion of the metallic stub 38 into the aperture 40, the auxiliary flange 37 cannot affect the flow of energy between the devices 10 and 12.

It is well-known to those in the art that the size and position of a stub relative to a waveguide determine the type of disturbance created. Turning to FIGS. 2(*a*) and 2(*b*), there are illustrated contrasting designs of auxiliary flanges for introducing inductive and capacitive disturbances respectively. The flange of FIG. 2(*a*) creates a disturbance to the transmission of electromagnetic energy between the rectangular waveguide-like ports of the devices 10 and 12 whose equivalent circuit is an inductor while that of FIG. 2(*b*) creates a disturbance whose equivalent circuit is represented by a capacitor. As can be seen, the stub 38 for producing an inductive disturbance is inserted horizontally into the aperture 40 whereas the capacitive stub 48 is inserted vertically. Accordingly, the width of the inductive stub 38 is approximately equal to the height of the aperture 40 while that of the capacitive stub 48 is approximately equal to the width of the rectangular aperture 40. In each case, the appropriate stub fills a corresponding dimension of the aperture and thereby reduces the size of the transverse dimensions thereof as it is advanced.

Contrasting the auxiliary flanges of Figures 2(*a*) and 2(*b*), one can see that the two devices differ in the dimensions of the metallic stubs 38 and 48 and the accommodating insertion grooves 42 and 46 respectively for connecting the internal apertures 40 and 50 to the access edge of the auxiliary flange. The positions of the inserted stubs 38 and 48 for producing inductive and capacitive effects are shown in shadow outline in the respective figures.

FIG. 3 is a cross-sectional view of the inductive flange taken at line 3—3 of FIG. 2(*a*). As can be observed, the groove 42 is of depth "d", approximately matching the thickness of the stub 38. It is well known in the art that the thickness of the stub 38 has an effect upon the inductive (likewise, capacitive) disturbance caused by such an element.

In use, the auxiliary flange of the invention may be utilized in a number of ways to adjust the impedance of either of the devices 10 or 12 or to adjust the impedance of an electromagnetic circuit comprising such devices. This may be accomplished by affixing the auxiliary flange 37 in a sandwich-like arrangement between the port flanges 18 and 20 as shown in FIG. 1. The auxiliary flange may be of either inductive design as shown in FIGS. 1 and 2(*a*) or of capacitive design as shown in FIG. 2(*b*). Alternatively, as mentioned earlier, auxiliary flanges of both designs may inserted next to one another between the port flanges 18 and 20 in a sandwich-like arrangement. Electromagnetic energy is then "fed" from the port of One of the devices 10, 12 to the other. Conventional means is employed for measuring the amount of energy transferred from one device to the other.

Either an experimental ("trial and error") method or an analytical process, or a combination of both, may then be employed to determine the correct "setting" of the stub within the aperture of the auxiliary flange. In the event an analytical process (e.g. a scalar or vector network analysis with reference to an appropriate Smith Chart) is employed, the stub(s) may be moved to the calculated position(s) to check the correctness of the analytical result. Further, in view of the inherent imperfections of analytical solutions, stub adjustment may be employed to then fine tune the "rough" analytical solution. Whether a purely experimental adjustment process or a combined analysis-and-experimentation process is employed, the optimum (impedance match or intentional impedance mismatch) result is ascertained by observing the input and output values on an appropriate display as the stub insertion/aperture adjustment process takes place.

Once the desired coupling characteristics are obtained, the designer may then proceed in a number of ways to utilize the information obtained through use of the auxiliary test flange. In the event that only laboratory experimentation is contemplated, the arrangement may remain assembled as implied by FIG. 1 for the purpose of making future readings with regard to the effects of changes in frequency, power and the like. In the event that the designer's goal is to modify one or the other of the devices 10, 12 to obtain the ascertained impedance modification, this result may achieved by measuring the reduced aperture of the auxiliary flange and then fabricating a "permanent auxiliary" flange with an aperture whose dimensions match those of the optimized auxiliary test flange.

Figure 4:
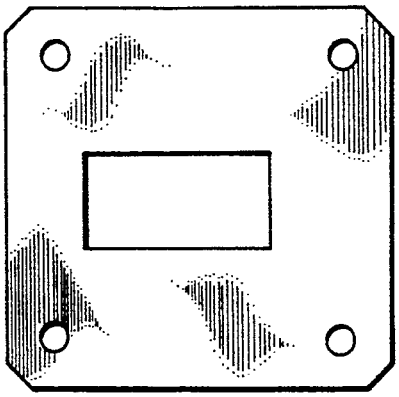
Figure 4:
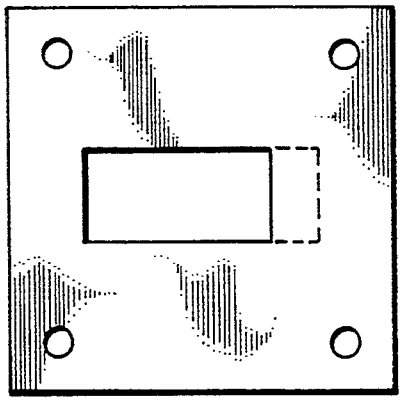

FIGS. 4(*a*) and 4(*b*) disclose an auxiliary test flange after the determination of the proper stub insertion length "l" and the corresponding permanent auxiliary flange fabricated to obtain the same effect as an element of a port 18 or 20.

As a further alternative, the port flange of the device 10 or 12 may itself be directly modified by the addition of a stub of length l into the rectangular aperture of the port. FIG. 4(*c*) is a frontal view of the port flange 20 of the device 12 after modification in accordance with the dimensions of the optimized auxiliary test flange of FIG. 4(*a*).

Thus it is seen that the present invention provides both an apparatus and a method for adjusting the impedance of a device of the type that includes a port comprising rectangular waveguide. Such apparatus allows one to match the impedance of a first device to that of a second device without affecting device integrity. Accordingly, the associated procedures for obtaining a desired degree of energy transfer are only minimally-intrusive, simple and, therefore, relatively quick and economical. By employing the apparatus and method of the invention, one may readily modify existing, otherwise sub-optimum, devices for usage outside original design specifications. Further, the invention permits one to "salvage" otherwise-unacceptable devices.

While this invention has been described with reference to its presently preferred embodiment it is not limited thereto. Rather, this invention is limited only insofar as it is defined by the following set of patent claims and includes within its scope all equivalents thereof.

What is claimed is:

1. Apparatus for adjusting the impedance of a first device of the type that includes a first port comprising rectangular waveguide and terminating in a planar mounting surface for interfacing a planar mounting surface of a second port of a second device, said apparatus comprising, in combination:

a) a substantially-planar metallic member having an internal aperture;

b) means for affixing said member to said first port;

c) a generally-rectangular, planar metallic stub;

d) said metallic member including a groove that extends from an edge of said member to said aperture for accommodating said stub in slidable relationship therewith; and e) the depth of said groove being substantially equal to the thickness of said stub.

2. Apparatus as defined in claim 1 further characterized in that:

a) said aperture is generally-rectangular; and b) the height of said aperture is a first length and

3. Apparatus as defined in claim 2 wherein the width of said stub is approximately equal to said first length.

4. Apparatus as defined in claim 2 wherein the width of said stub is approximately equal to said second length.

5. A method for adjusting the impedance of a first device of the type that includes a first port comprising rectangular waveguide and terminating in a planar mounting surface relative to that of a second device of the type that includes a second port comprising rectangular waveguide and having a substantially-planar mounting surface for interfacing said first port, said method comprising the steps of:

a) inserting a substantially-planar metallic member between and in mutual contact with said substantially-planar mounting surfaces, said member including an internal aperture and a groove extending from said aperture to an edge thereof for accommodating a substantially-planar metallic stub therein such that the surface of said planar stub is substantially coplanar with the upper surface of said member; then b) directing electromagnetic energy from said first device to said second device through said ports; then c) measuring the electromagnetic energy coupled from said first device to said second device; then d) sliding said substantially-planar metallic stub within said groove to thereby affect the size of said aperture; and e) measuring the electromagnetic energy transmitted into said second device; and then f) continuing to slide said substantially-planar metallic stub within said groove while measuring said electromagnetic energy until a predetermined amount of electromagnetic energy is measured at said second device.

6. A method as defined in claim 5 further including the steps of:

a) measuring the size of said reduced aperture; then b) fabricating a substantially-planar metallic member with an internal aperture of said measured size; and then c) fixing said fabricated member to said port of said second device.

7. A method as defined in claim 5 further including the steps of:

a) measuring the size of said reduced aperture; and then b) fixing a stub to said port of said second device such that the aperture of said port is equal to said reduced aperture.

* * * * *